US010607794B2

(12) United States Patent
Chen et al.

(10) Patent No.: US 10,607,794 B2
(45) Date of Patent: Mar. 31, 2020

(54) KEYBOARD, KEY MODULE, MOVABLE SWITCH MECHANISM AND METHOD FOR MANUFACTURING MOVABLE SWITCH MECHANISM

(71) Applicants: LITE-ON ELECTRONICS (GUANGZHOU) LIMITED, Guangzhou (CN); LITE-ON TECHNOLOGY CORPORATION, Taipei (TW)

(72) Inventors: Chun-Lin Chen, Taipei (TW); Jui-Yu Wu, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 16/004,249

(22) Filed: Jun. 8, 2018

(65) Prior Publication Data

US 2018/0358193 A1 Dec. 13, 2018

(30) Foreign Application Priority Data

Jun. 12, 2017 (CN) ..... 2017 1 0438199

(51) Int. Cl.
*H01H 13/85* (2006.01)
*H01H 13/7065* (2006.01)
(Continued)

(52) U.S. Cl.
CPC ..... *H01H 13/85* (2013.01); *H01H 11/06* (2013.01); *H01H 13/704* (2013.01);
(Continued)

(58) Field of Classification Search
CPC ..... H01H 13/85; H01H 11/06; H01H 13/88; H01H 13/79; H01H 13/704;
(Continued)

(56) References Cited

U.S. PATENT DOCUMENTS 4,365,120 A * 12/1982 Pounds ..... H01H 13/83 200/314
5,772,010 A 6/1998 Watanabe et al.
(Continued)

FOREIGN PATENT DOCUMENTS

CN 1161554 A 10/1997
CN 2423647 Y 3/2001
(Continued)

*Primary Examiner* — Edwin A. Leon
*Assistant Examiner* — Lheiren Mae A Caroc
(74) *Attorney, Agent, or Firm* — Li & Cai Intellectual Property (USA) Office

(57) ABSTRACT

A keyboard includes a plurality of key modules. Each key module includes a baseplate, a circuit membrane disposed on the baseplate, a metal dome disposed on the circuit membrane, an elastic member disposed on the metal dome, and a keycap. The elastic member and the linkage member are configured to be a movable switch mechanism. The circuit membrane has a conductive circuit. The metal dome has an opening corresponding to the conductive circuit of the circuit membrane. A trigger portion protrudes from an underside of the elastic member. When the keycap is pressed, the trigger portion passes through the opening of the metal dome, and moves downwards to abut against the conductive circuit to induce a conducting signal. The movable switch mechanism can be made by a double injection molding method.

16 Claims, 7 Drawing Sheets

(51) Int. Cl.

| | |
|---|---|
| ***H01H 13/704*** | (2006.01) |
| ***H01H 13/79*** | (2006.01) |
| ***H01H 13/88*** | (2006.01) |
| ***H01H 11/06*** | (2006.01) |
| *H01H 13/83* | (2006.01) |

(52) U.S. Cl.
CPC ..... *H01H 13/7065* (2013.01); *H01H 13/79* (2013.01); *H01H 13/88* (2013.01); *H01H 13/83* (2013.01); *H01H 2215/006* (2013.01); *H01H 2215/014* (2013.01); *H01H 2219/054* (2013.01); *H01H 2221/044* (2013.01); *H01H 2221/05* (2013.01); *H01H 2227/0261* (2013.01); *H01H 2229/044* (2013.01); *H01H 2229/046* (2013.01)

(58) Field of Classification Search
CPC ..... H01H 13/7065; H01H 2229/046; H01H 2215/014; H01H 13/83; H01H 2221/05; H01H 2221/044; H01H 2215/006
USPC ..... 200/406, 408, 5 A, 341, 344, 345, 516
See application file for complete search history.

(56) References Cited

U.S. PATENT DOCUMENTS

| | | | | |
|---|---|---|---|---|
| 2001/0027914 | A1* | 10/2001 | Hsu ..... | H01H 3/125 200/344 |
| 2017/0011869 | A1 | 1/2017 | Knopf et al. | |

FOREIGN PATENT DOCUMENTS

| | | | |
|---|---|---|---|
| CN | 101286423 | A | 10/2008 |
| TW | 403925 | | 9/2000 |
| TW | 201039367 | A1 | 11/2010 |
| TW | 201517099 | A | 5/2015 |

* cited by examiner

KEYBOARD, KEY MODULE, MOVABLE SWITCH MECHANISM AND METHOD FOR MANUFACTURING MOVABLE SWITCH MECHANISM

BACKGROUND OF THE INVENTION

1. Field of the Invention

The present disclosure is related to a keyboard and a key module thereof, and more particularly to a key module having a movable switch mechanism which not only can be used to guide a keycap to move upwards or downwards, but also brings a circuit into conduction to induce a signal when the key module is depressed.

2. Description of Related Art

A general keyboard used for computers usually uses a plastic dome disposed between a keycap and a circuit membrane. The plastic dome is used to return the keycap to its original position with an upward restoring force and cause the bottom of the keycap to touch the circuit membrane to induce a conductive signal. This kind of keyboard provides a better typing tactility with a longer stroke or travel distance, but has a higher total height.

Further, compact keyboards, such as those used for mobile phones or portable electronic devices, usually include a metal dome disposed between the keycap and the circuit membrane. When the keycap is pressed, a rod on the bottom surface of the keycap abuts against the metal dome and presses the metal dome downwards to contact the circuit membrane to produce a conductive signal. This kind of keyboard provides a rough and poor typing tactility with a shorter travel distance. Moreover, if the metal dome is excessively squeezed or repeatedly withstands compressive loads, it may easily experience fatigue of material and have a shortened service life.

SUMMARY OF THE INVENTION

One of the objectives of the present disclosure is to provide a keyboard, a key module of a keyboard, and a movable switch mechanism of a keyboard, which provides an elastic member with resilience to activate a conductive circuit, so as to provide a better typing tactility. In addition, the present disclosure can prevent the metal dome from being excessively squeezed, so as to prolong the useful life of the metal dome.

In order to achieve the above objectives, according to one exemplary embodiment of the present disclosure, a key module is provided and includes a baseplate, a circuit membrane disposed on the baseplate, a metal dome disposed on a top surface of the circuit membrane, an elastic member disposed on the metal dome, and a keycap arranged above the elastic member. The circuit membrane has a conductive circuit. The metal dome has an opening, and a position of the opening corresponds to the conductive circuit of the circuit membrane. The elastic member has a trigger portion protruding from an underside of elastic member, and the trigger portion passes through the opening of the metal dome. When the keycap is pressed, the trigger portion of the elastic member moves downwards to abut against the conductive circuit so as to induce a conducting signal.

In order to achieve the above objectives, according to one exemplary embodiment of the present disclosure, a keyboard is provided and includes a plurality of key modules. Each key module includes a baseplate, a circuit membrane disposed on the baseplate, a metal dome disposed on a top surface of the circuit membrane, an elastic member disposed on the metal dome, and a keycap arranged above the elastic member. The circuit membrane has a conductive circuit. The metal dome has an opening, and a position of the opening corresponds to the conductive circuit of the circuit membrane. The elastic member has a trigger portion protruding from an underside of the elastic member, and the trigger portion passes through the opening of the metal dome. When the keycap is pressed, the trigger portion of the elastic member moves downwards to abut against the conductive circuit so as to induce a conducting signal.

In order to achieve the above objectives, according to one exemplary embodiment of the present disclosure, a movable switch mechanism is provided and includes an elastic member and a linkage member. The elastic member has a trigger portion protruded from an underside thereof, and the trigger portion is used to actuate a conductive circuit of a keyboard. The linkage member includes a first frame and a second frame. The second frame is pivotally connected to an inner side of the first frame. The second frame has an accommodating portion. The elastic member is fixedly connected in the accommodating portion of the second frame.

One of the objectives of the present disclosure is further to provide a method for manufacturing a movable switch mechanism of the keyboard, which uses a double injection molding method to integrally combine an elastic member with a second frame of the linkage member.

In order to achieve the above objectives, according to one exemplary embodiment of the present disclosure, a method for manufacturing a movable switch mechanism is provided, which includes steps as follows. A rigid material is injected into a mold by a plastic injection molding process to form a second frame of a connecting-type component. An elastic material is injected into the mold to form an elastic member, and simultaneously affixes a periphery of the elastic member to a center of the second frame. The second frame is assembled with an inner side of a first frame in a pivoting manner.

According to one practical embodiment of the present disclosure, the rigid material is polyoxymethylene, and the elastic material is silicone rubber.

Thus, in the present disclosure, the elastic member has a trigger portion that passes through the metal dome to contact the circuit membrane when the keycap is depressed, so that the typing tactility is much more resilient. According to the present disclosure, the key module has a longer typing stroke and longer travel distance with a distance for elastic compression provided by the elastic member in addition to a distance of the metal dome to be pressed down. The metal dome of the present disclosure does not directly contact the circuit membrane even if the keycap is pressed to a bottommost position, so that it can avoid excessive squeezing and deformation of the metal dome and enjoy a prolonged service life.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
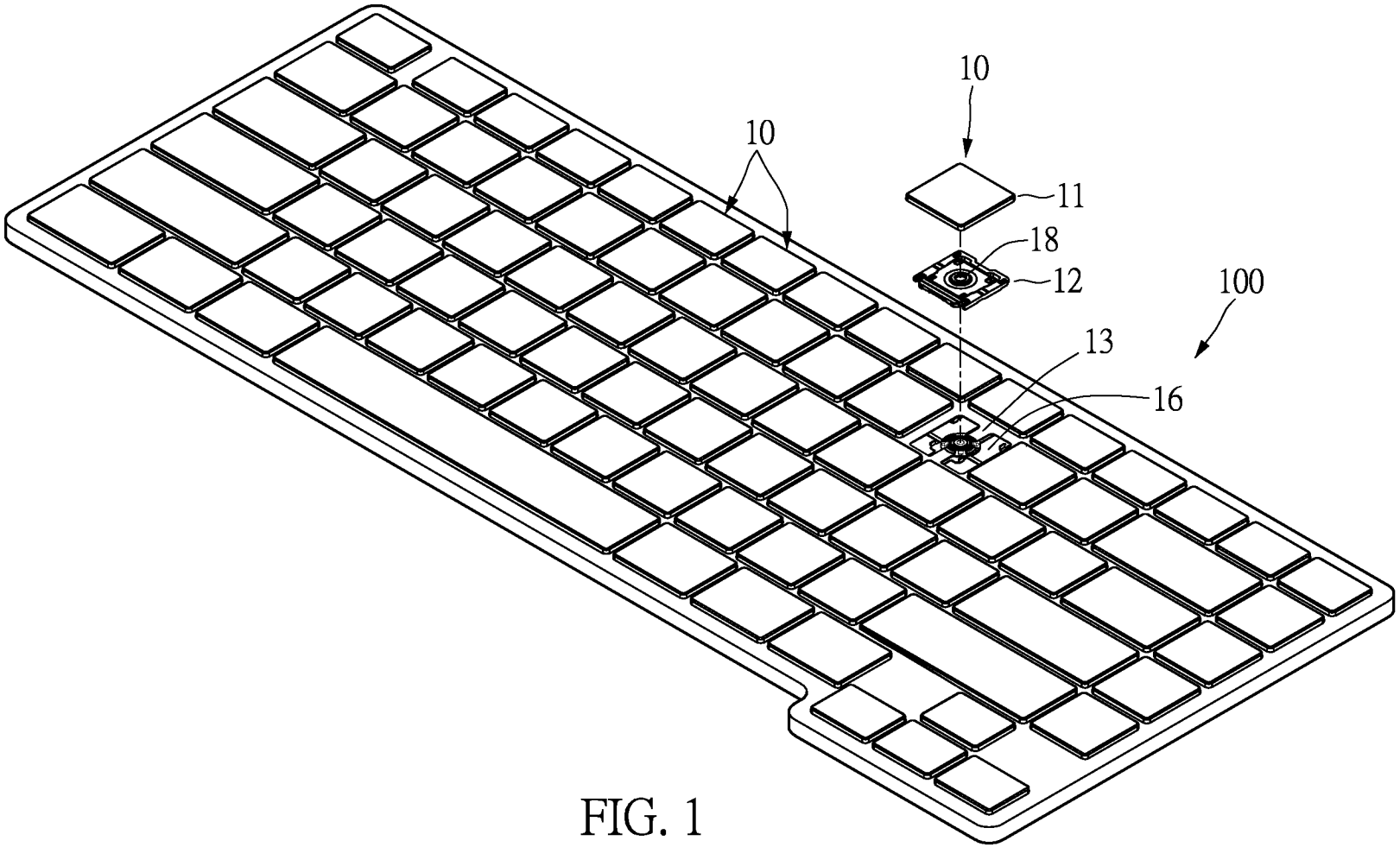
FIG. 1 is a perspective view of a keyboard of the present disclosure.
Figure 2:
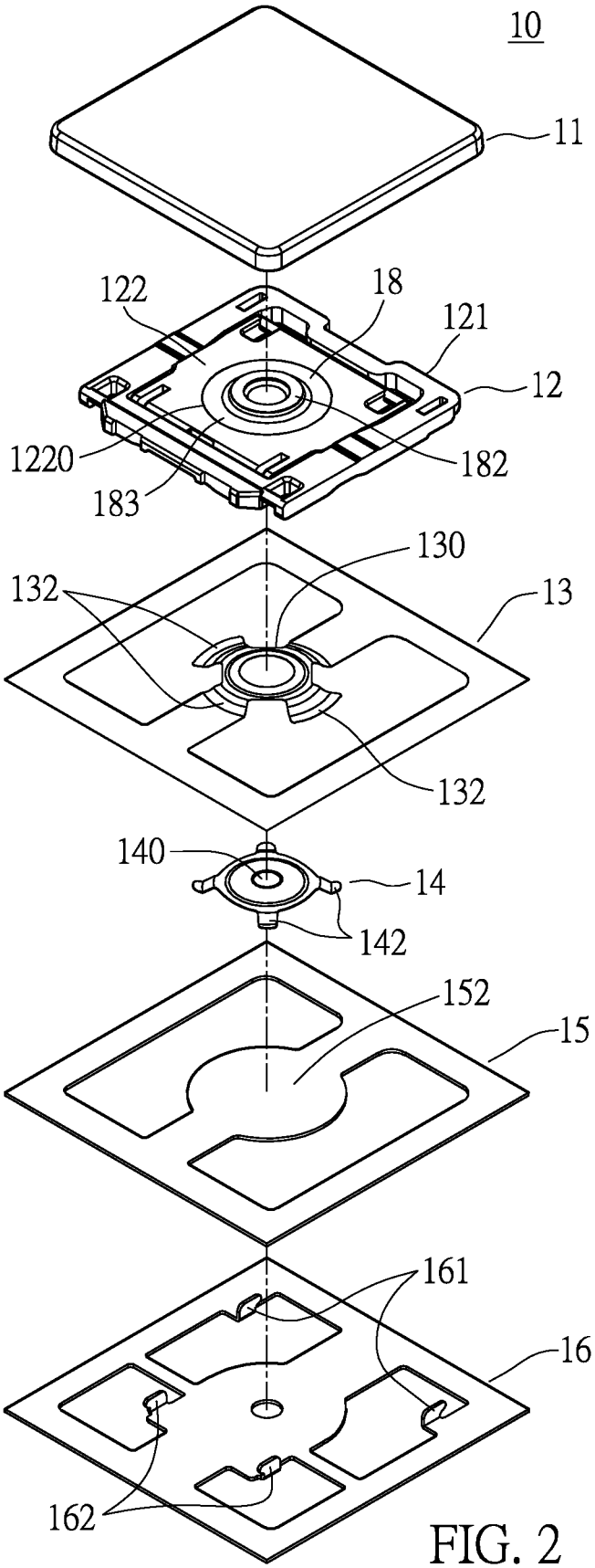
FIG. 2 is an exploded view of a key module of the present disclosure.
Figure 3:
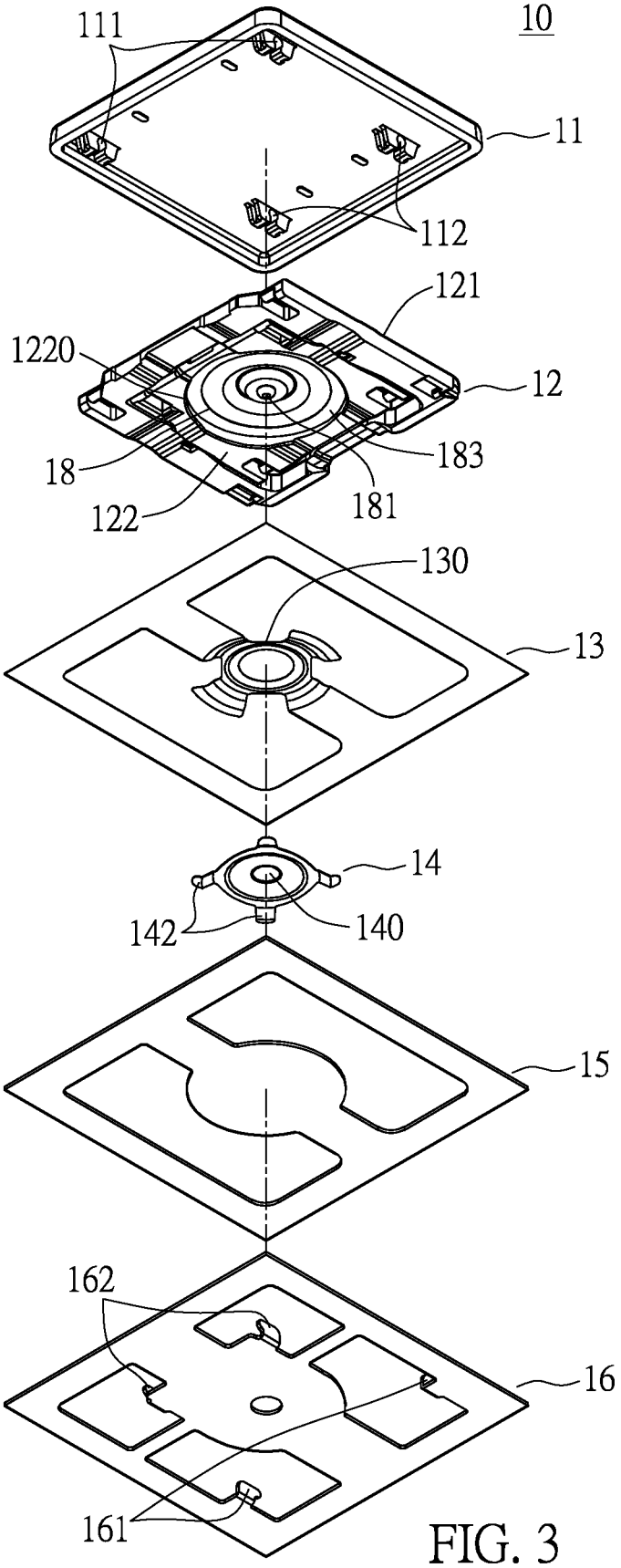
FIG. 3 is another exploded view of the key module of the present disclosure.

Reference is made to FIG. 1 to FIG. 3. FIG. 1 is a perspective view showing a keyboard having a plurality of key modules according to the present disclosure. FIG. 2 and FIG. 3 are exploded views of the key module of the present disclosure. The present disclosure provides a keyboard 100, which includes a plurality of key modules 10. Each key module 10 includes a keycap 11, a linkage member 12, a metal dome 14, a circuit membrane 15, a baseplate 16 and an elastic member 18. The elastic member 18 and the linkage member 12 are configured to be assembled to form a movable switch mechanism.

The baseplate 16 can be formed by stamping or punching of a metal board. The baseplate 16 has a restricting unit. In this embodiment, the restricting unit includes a pair of first hooking parts 161 and a pair of second hooking parts 162, which are reverse-L shaped and used to connect a lower portion of the linkage member 12. However, the restricting unit of the present disclosure is not limited thereto.

The circuit membrane 15 is disposed on the baseplate 16, and has a conductive circuit 152. The structure of the conductive circuit 152, for example, has an upper conductive piece, a lower conductive piece and a spacer between the upper and lower conductive pieces. When the conductive circuit 152 is pressed, the upper conductive piece and the lower conductive piece are touched and electrically contacted to produce a signal.

The metal dome 14 is disposed on a top surface of the circuit membrane 15, and has an opening 140 which is, for example, positioned directly at the central portion of the metal dome 14. A position of the opening 140 corresponds to a position of the conductive circuit 152 of the circuit membrane 15.

The elastic member 18 is disposed under the keycap 11 and on a top end of the metal dome 14. The elastic member 18 has a trigger portion 181 protruding from an underside thereof. The trigger portion 181 passes through the opening 140 of the metal dome 14. The keycap 11 is disposed above the elastic member 18.

Figure 4:
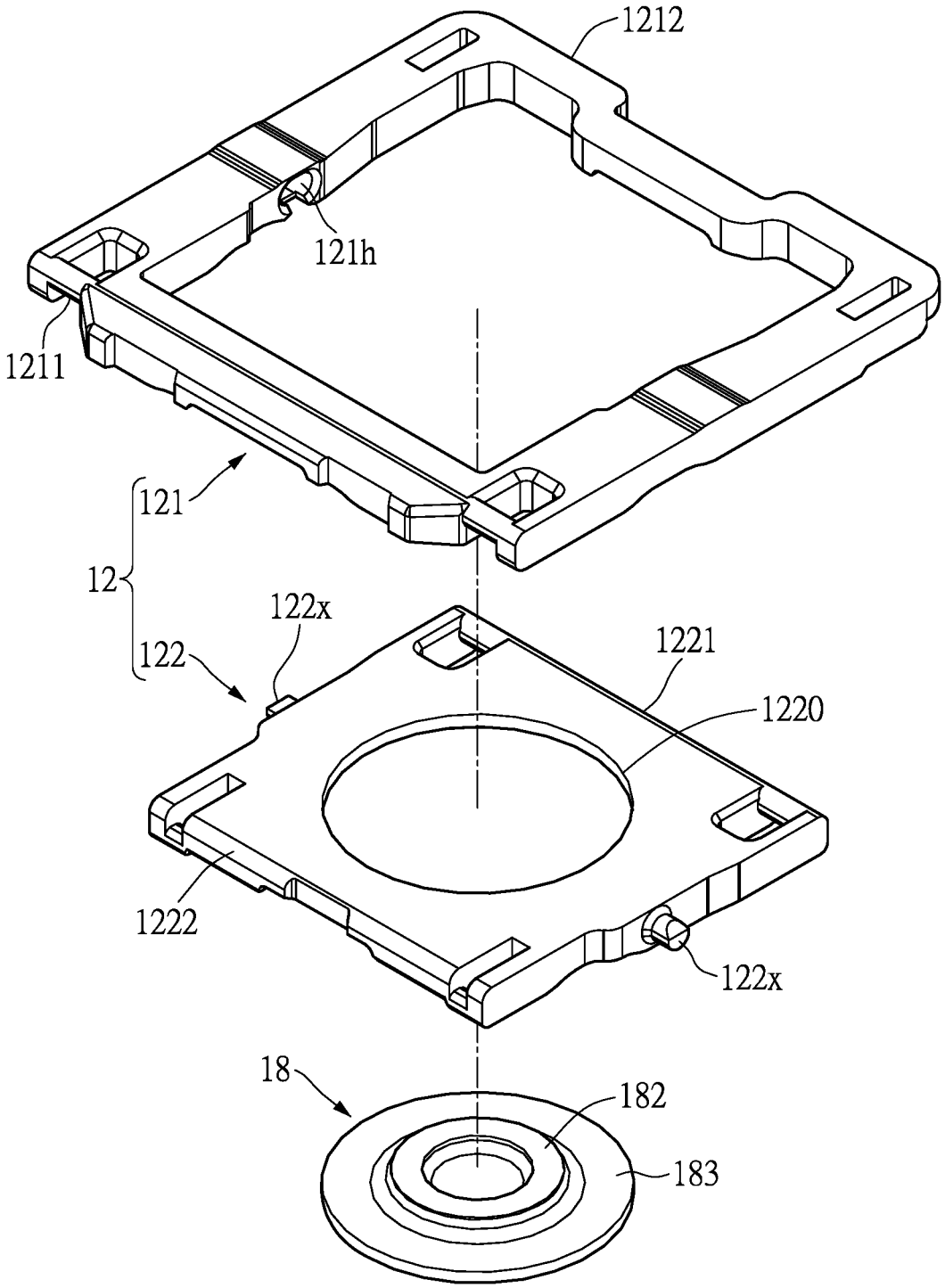
FIG. 4 is an exploded perspective view of a movable switch mechanism of the keyboard of the present disclosure.
Figure 5:
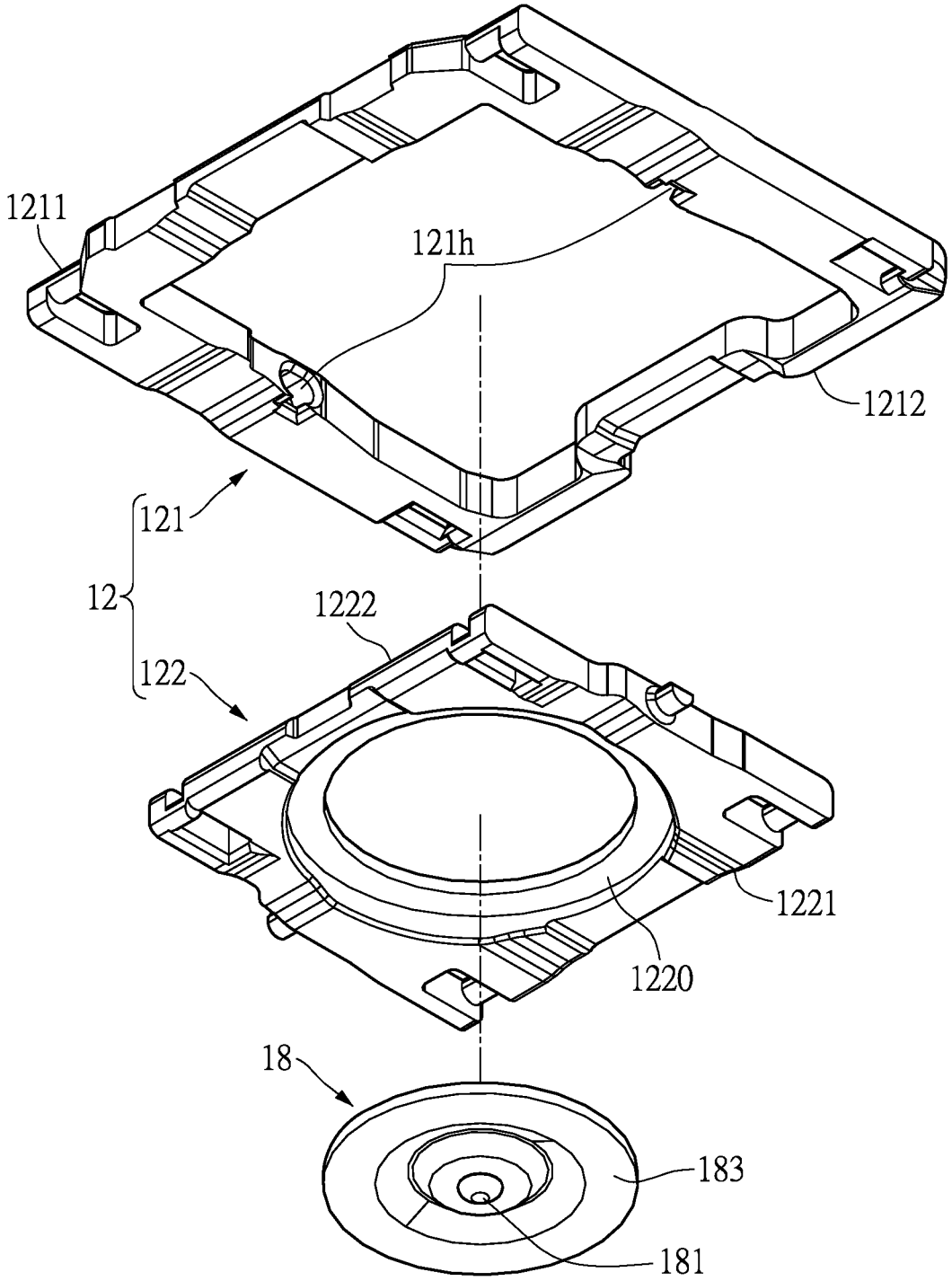
FIG. 5 is another exploded perspective view of the movable switch mechanism of the keyboard of the present disclosure.
Figure 6:
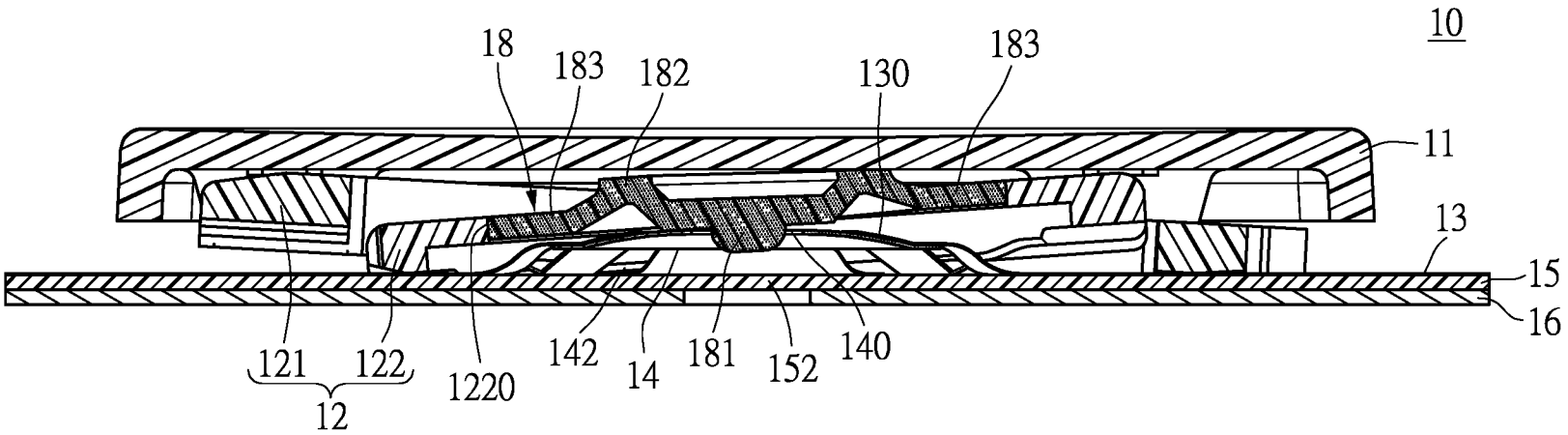
FIG. 6 is a cross-sectional view of the key module of the present disclosure being in an unpressed state.
Figure 7:
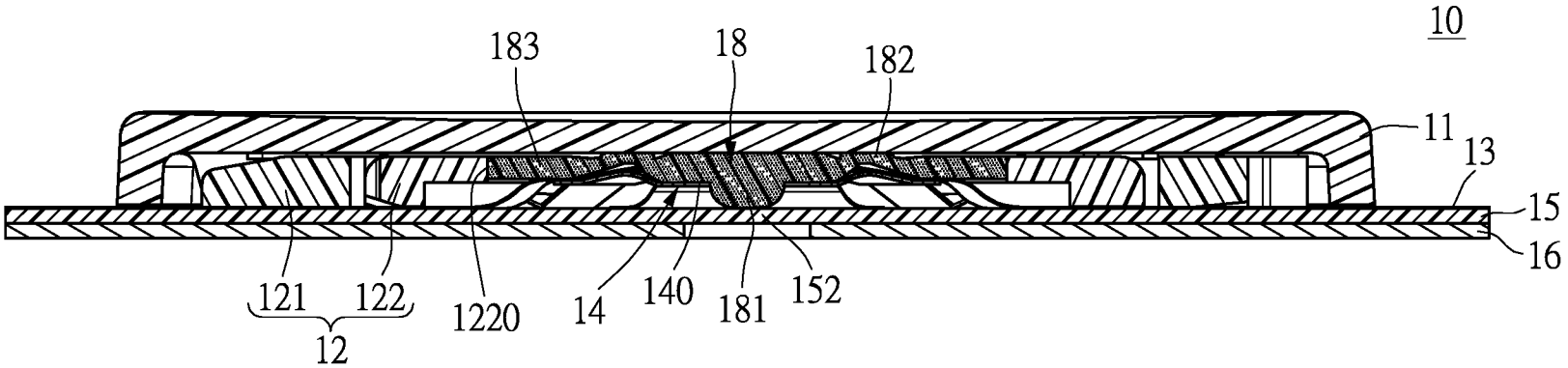
FIG. 7 is a cross-sectional view of the key module of the present disclosure being in a pressed state.

Reference is made to FIG. 4 and FIG. 5, which are exploded perspective views of the movable switch mechanism of the keyboard according to the present disclosure. The linkage member 12 is disposed on and connected to the baseplate 16. The linkage member 12 includes a first frame 121 and a second frame 122. The second frame 122 is pivotally connected to the first frame 121, for example, on an inner side thereof. As shown in FIG. 4, two outer sides of the second frame 122 have an axial part 122*x*, respectively, and two inner sides of the first frame 121 are formed with an axial hole 121*h*, respectively. The axial parts 122*x* are respectively inserted into the axial holes 121*h*, such that the second frame 122 is pivotally connected to the first frame 121. The second frame 122 has an accommodating portion 1220, and the elastic member 18 is fixedly affixed in the accommodating portion 1220 of the second frame 122. As shown in FIG. 3, the accommodating portion 1220 is preferably stair-shaped. An outer edge of the elastic member 18 is attached to an inner edge around an upper opening of the accommodating portion 1220, and a lower part of the accommodating portion 1220 can further receive a part of the metal dome 14, as shown in FIG. 6 and FIG. 7.

The elastic member 18 includes an upper ring 182 and an outer ring 183. The upper ring 182 extends upwards from a periphery of the trigger portion 181 and abuts against the keycap 11. The outer ring 183 extends downwards and outwards from the upper ring 182. The outer ring 183 is attached to the periphery of the accommodating portion 1220, and the upper ring 182 protrudes above a top surface of the second frame 122.

Reference is made to FIG. 3. The keycap 11 has a pivoting unit. The first side 1211 of the first frame 121 is rotatably connected to the pivoting unit, and the second side 1212 of the first frame 121 is slidably connected to the restricting unit. The first side 1221 of the second frame 122 is rotatably connected to the pivoting unit, and the second side 1222 of the second frame 122 is slidably connected to the restricting unit. The pivoting unit includes a pair of first pivoting parts 111 and a pair of second pivoting parts 112. The first side 1211 of the first frame 121 is pivotally connected to the first pivoting part 111, and the first side 1221 of the second frame 122 is pivotally connected to the second pivoting part 112.

Reference is made to FIG. 2 and FIG. 3. In this embodiment, the keyboard 100 further includes a supporting film 13. The supporting film 13 is disposed above the metal dome 14. The supporting film 13 can be made of a polyester film, such as Mylar® film, which can protect sensitive electronic elements and key components, so as to prevent liquid from permeating therein. The supporting film 13 has a retaining ring 130 which is used to fix the metal dome 14 onto the circuit membrane 15. During an assembling process of the keyboard 100, the metal domes 14 of the key modules 10 can be firstly affixed on the supporting film 13, and the supporting film 13 can be attached to the circuit membrane 15. In this embodiment, the supporting film 13 further has a plurality of extension parts 132. The extension parts 132 extend outwards from a periphery of the retaining ring 130. The metal dome 14 has a plurality of seat portions 142. The extension parts 132 respectively cover the seat portions 142. The seat portions 142 abut against the circuit membrane 15. However, the supporting film 13 of the present disclosure may be omitted in another embodiment.

In addition, one implementation of the movable switch mechanism of the present disclosure is using a double injection molding method to form a movable switch mechanism in single integral piece. More specifically, the present disclosure further provides a method for manufacturing a movable switch mechanism of a keyboard, which includes steps as follows.

A rigid material is injected into a mold by a plastic injection molding method, so as to form a second frame 122 of a linkage member 12.

Then, an elastic material is injected into the mold by a plastic injection molding method, so as to form an elastic member 18 having a trigger portion 181. A periphery of the elastic member 18 is attached or fixed to a central portion of the second frame 122.

The second frame 122 with the elastic member 18 is assembled to a first frame 121, so as to form a movable switch mechanism.

The rigid material could be polyoxymethylene (POM), also known as acetal, polyacetal, or polyformaldehyde, which is an engineering thermoplastic used for precision parts requiring high stiffness, low friction, and excellent dimensional stability. The elastic material could be silicone rubber, also known as polymerized siloxane. However, the present disclosure is not limited thereto. For example, other artificial plastic can be used.

In another embodiment, the elements of the linkage member 12 can be simultaneously injected in the first plastic injection step, so that the second frame is assembled with the first frame in a single step.

Reference is made to FIG. 6 and FIG. 7, which are cross-sectional views of the key module in an unpressed state and in a pressed state. According to the structure of the present disclosure, when the keycap 11 is not pressed, the elastic member 18 with resilience can prop up the keycap 11. As shown in FIG. 6, the elastic member 18 of this embodiment has a smaller height, and is mostly located on a disk-shaped surface formed by the outer ring 183. The trigger portion 181 protrudes downwards from the disk-shaped surface, and the upper ring 182 is a protruded ring between the outer ring 183 and the trigger portion 181. A height of the trigger portion 181 is substantially equal to a thickness of the outer ring 183. An excess height of the upper ring 182 over a top surface of the outer ring 183 is substantially equal to a thickness of the outer ring 183. In addition, the trigger portion 181 of the elastic member 18 passes through the metal dome 14 and protrudes slightly above a bottom surface of the metal dome 14. A bottom end of the elastic member 18 is supported by the metal dome 14 and does not contact the circuit membrane 15.

Upon the keycap 11 is pressed, the elastic member 18 is first pressed to deform, thereby providing the user with a tactile feedback of elastomeric resilience. While the keycap 11 is continuously pressed downwards, the metal dome 14 is then depressed to deform. In the meantime, the trigger portion 181 of the elastic member 18 moves downwards to abut against and touch the circuit membrane 15 which is therefore brought into conduction, so as to induce a conductive signal. As shown in FIG. 7, after the key module 10 of this embodiment is pushed down, a distance between the bottom surface of the keycap 11 and the circuit membrane 15 is substantially equal to the height of the linkage member 12. The distance between the bottom surface of the keycap 11 and the circuit membrane 15 is, for example, substantially equal to the height of the second frame 122 when the key module 10 is pressed down. The metal dome 14 is depressed to be under the accommodating portion 1220 of the second frame 122. The elastic member 18 is pressed to be substantially aligned with the top surface of the second frame 122.

The configuration of the present disclosure is different from the conventional structure. In the conventional art, a middle post of the keycap is deployed to directly contact the metal dome, which results in a rough and poor typing tactility. The trigger portion 181 of the elastic member 18 in the present disclosure passes through the metal dome 14 and contacts the circuit membrane 15 when being depressed, which provides a typing tactility with considerable resilience.

In addition, the pressing stroke in the conventional art only provides a distance where the metal dome moves downwards to abut against the conductive circuit. In this embodiment, the total key travel distance includes a distance of elastic compression firstly provided by the elastic member 18 and then a distance of the metal dome 14 to be pressed. Therefore, the key module of the present disclosure provides a longer travel distance for typing stroke. Further, the metal dome 14 of the present disclosure does not contact the circuit membrane 15 even when being pressed to the bottommost position, so that it can prevent the metal dome 14 from withstanding repeated compressive loads and deformation, thereby providing a prolonged service life.

Figure 8:
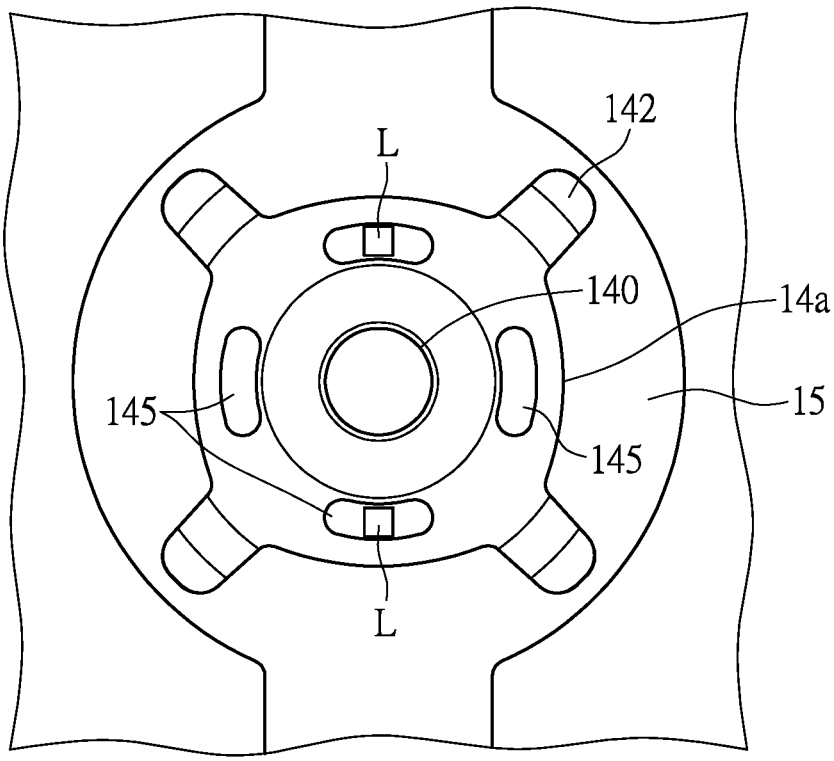
FIG. 8 is a top view of the key module having a metal dome according to a second embodiment of the present disclosure.

Reference is made to FIG. 8, which shows a metal dome of a second embodiment of the key module according to the present disclosure. In another embodiment of the present disclosure, the metal dome 14 further has at least one light hole 145 enabling light to pass through. At least one illuminating element L is disposed on the circuit membrane 15. The elastic member 18 can be made of light-transmittable material. Light emitted from the illuminating element L passes through the light hole 145 and the elastic member 18 to illuminate the keycap 11. Therefore, the keyboard 100 of the present disclosure can be a backlit keyboard.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A key module, comprising:

a baseplate;

a circuit membrane disposed on the baseplate, the circuit membrane having a conductive circuit;

a metal dome disposed on a top surface of the circuit membrane, the metal dome having an opening corresponding to the conductive circuit of the circuit membrane;

an elastic member disposed on the metal dome, the elastic member having a trigger portion protruding from an underside of the elastic member, the trigger portion passing through the opening of the metal dome; and a keycap arranged above the elastic member;

wherein when the keycap is pressed, the trigger portion of the elastic member moves downwards to abut against the conductive circuit to induce a conducting signal.

2. The key module as claimed in claim 1, further comprising a linkage member, the linkage member being disposed on the baseplate and connected to the baseplate, wherein the linkage member includes a first frame and a second frame, the second frame being pivotally connected to the first frame and having an accommodating portion, the elastic member being fixedly connected in the accommodating portion of the second frame.

3. The key module as claimed in claim 2, wherein the keycap has a pivoting unit, and the baseplate has a restricting unit, wherein a first side of the first frame is pivotally connected to the pivoting unit, and a second side of the first frame is slidably connected to the restricting unit, and wherein a first side of the second frame is pivotally connected to the pivoting unit, and a second side of the second frame is slidably connected to the restricting unit.

4. The key module as claimed in claim 2, wherein the elastic member has an upper ring and an outer ring, and wherein the upper ring extends upwards from a periphery of the trigger portion and abuts against the keycap, the outer ring extends downwards and outwards from the upper ring, the outer ring is affixed to a periphery of the accommodating portion, and the upper ring protrudes over a top surface of the second frame.

5. The key module as claimed in claim 1, further comprising a supporting film, the supporting film being disposed on the metal dome, the supporting film having a retaining ring, and the retaining ring fixing the metal dome on the circuit membrane.

6. The key module as claimed in claim 5, wherein the supporting film further includes a plurality of extension parts outward extended from a periphery of the retaining ring, and the metal dome has a plurality of seat portions, the extension parts covering the seat portions.

7. The key module as claimed in claim 1, wherein the metal dome has a light hole, an illuminating element is disposed on the circuit membrane, and the elastic member is made of light-transmittable material, a light from the illuminating element passing through the light hole and the elastic member to illuminate the keycap.

8. A keyboard, comprising:

a plurality of key modules, each of the key modules includes:

a baseplate;

a circuit membrane, disposed on the baseplate, the circuit membrane having a conductive circuit;

a metal dome, disposed on a top surface of the circuit membrane, the metal dome having an opening corresponding to the conductive circuit of the circuit membrane;

an elastic member, disposed on the metal dome, the elastic member has a trigger portion protruding from an underside of the elastic member, the trigger portion passing through the opening of the metal dome; and a keycap, arranged above the elastic member;

wherein when the keycap is pressed, the trigger portion of the elastic member moves downwards to abut against the conductive circuit so as to induce a conducting signal.

9. The keyboard as claimed in claim 8, further comprising a linkage member having a first frame and a second frame, wherein the baseplate has a restricting unit, the linkage member being disposed on and connected to the baseplate, the second frame being pivotally connected to the first frame, and the elastic member being fixedly connected in an accommodating portion of the second frame.

10. The keyboard as claimed in claim 9, wherein the keycap has a pivoting unit, wherein a first side of the first frame is pivotally connected to the pivoting unit, and a second side of the first frame is slidably connected to the restricting unit; wherein a first side of the second frame is pivotally connected to the pivoting unit, and a second side of the second frame is slidably connected to the restricting unit.

11. The keyboard as claimed in claim 9, wherein an upper ring of the elastic member is extended upwards from a periphery of the trigger portion to abut against the keycap, and an outer ring of the elastic member is extended downwards and outwards from the upper ring and attached to a periphery of the accommodating portion, the upper ring protruding above a top surface of the second frame.

12. The keyboard as claimed in claim 8, further comprising a supporting film, being disposed on the metal dome and having a retaining ring, the retaining ring fixing the metal dome on the circuit membrane.

13. The keyboard as claimed in claim 12, wherein the supporting film further includes a plurality of extension parts outward extended from a periphery of the retaining ring, and the metal dome has a plurality of seat portions covered with the extension parts.

14. The keyboard as claimed in claim 8, wherein the metal dome has a light hole, an illuminating element is disposed on the circuit membrane, and the elastic member is made of light-transmittable material, a light from the illuminating element passing through the light hole and the elastic member to illuminate the keycap.

15. A movable switch mechanism, being adapted to a keyboard, the keyboard including a circuit membrane and a metal dome disposed on the circuit membrane, comprising:

an elastic member, disposed on the metal dome and having a trigger portion protruding from an underside thereof, wherein the trigger portion of the elastic member passes through an opening of the metal dome positionally corresponding to a conductive circuit of the keyboard, and is configured to activate the conductive circuit of the keyboard; and a linkage member, including a first frame and a second frame, wherein the second frame is pivotally connected to the first frame, and the elastic member is fixedly connected in an accommodating portion of the second frame.

16. The movable switch mechanism as claimed in claim 15, wherein the elastic member has an upper ring and an outer ring, the upper ring is upwards extended from a periphery of the trigger portion, the outer ring is extended from the upper ring downwards and outwards, the outer ring is attached to a periphery of the accommodating portion, and the upper ring is protruded above a top surface of the second frame.

* * * * *